US009879199B2

(12) United States Patent
Baykara

(10) Patent No.: US 9,879,199 B2
(45) Date of Patent: Jan. 30, 2018

(54) MATERIAL SYSTEM WITH SUB-MICROMETER-SCALE INTERFACES EXHIBITING STRUCTURAL LUBRICITY UNDER AMBIENT CONDITIONS AND THE METHOD FOR SYNTHESIS THEREOF

(71) Applicant: Mehmet Z. Baykara, Ankara (TR)

(72) Inventor: Mehmet Z. Baykara, Ankara (TR)

( * ) Notice: Subject to any disclaimer, the term of this patent is extended or adjusted under 35 U.S.C. 154(b) by 165 days.

(21) Appl. No.: 14/953,000

(22) Filed: Nov. 26, 2015

(65) Prior Publication Data

US 2016/0369196 A1 Dec. 22, 2016

(30) Foreign Application Priority Data

Jun. 17, 2015 (TR) ..... 2015 07405

(51) Int. Cl.

| | |
|---|---|
| ***C10M 125/04*** | (2006.01) |
| ***C10M 171/00*** | (2006.01) |
| ***C23C 16/26*** | (2006.01) |
| ***B05D 5/08*** | (2006.01) |
| ***C10M 103/02*** | (2006.01) |
| ***C10M 169/00*** | (2006.01) |
| ***C10M 171/06*** | (2006.01) |

(52) U.S. Cl.

CPC ..... *C10M 125/04* (2013.01); *C10M 103/02* (2013.01); *C10M 169/00* (2013.01); *C10M 171/06* (2013.01); *C10M 2201/0413* (2013.01); *C10N 2220/082* (2013.01); *C10N 2230/06* (2013.01); *C10N 2270/00* (2013.01)

(58) Field of Classification Search

CPC ..... C10M 125/04; C10M 171/06; C10M 103/02; C10M 169/00; C10M 2201/0413; C10M 125/02; C10M 171/00; C23C 16/26; B05D 5/08; C10N 2270/00; C10N 2220/082; C10N 2230/06

See application file for complete search history.

(56) References Cited

FOREIGN PATENT DOCUMENTS

| | | | | |
|---|---|---|---|---|
| WO | WO 2012028695 A2 * | 3/2012 | ..... | C23C 18/08 |
| WO | WO 2014011954 A1 * | 1/2014 | ..... | B82Y 40/00 |

OTHER PUBLICATIONS

"Structure and nanotribology of thermally deposited gold nanoparticles on graphite" Ebru Cihan, Alper Ozogul and Mehmet Z Baykara Applied Surface Science 354 pp. 429-436 (Avail online Apr. 24, 2015).*

B. Bhushan, Introduction to Trilsology, Wiley, New York, 2013.

J. A. Greenwood, J. B. P. Williamson: "Contact of nominally flat surfaces", Proceedings of the Royal Society of London A, 295, pp. 300-319, 1966.

B. Bhushan, J. N. Israelachvili, U. Landman: "Nanotribology: friction, wear and lubrication at the atomic scale", Nature, vol. 374, pp. 607-616, Apr. 13, 1995.

C. M. Mate, Tribology on the Small Scale: A Bottom Up Approach to Friction, Lubrication, and Wear, Oxford University Press, Oxford, 2008.

P. J. Eaton, P. West, Atomic Force Microscopy, Oxford University Press, Oxford, 2010.

(Continued)

*Primary Examiner* — Pamela H Weiss

(74) *Attorney, Agent, or Firm* — Gokalp Bayramoglu

(57) ABSTRACT

Invention is related with a material system with sub-micrometer-scale interfaces exhibiting structural lubricity under ambient conditions.

8 Claims, 5 Drawing Sheets

(56) References Cited

OTHER PUBLICATIONS

R. W. Carpick, M. Salmeron "Scratching the Surface: Fundamental Investigations of Tribology with Atomic Force Microscopy", Chemical Reviews, 97, 4, pp. 1163-1194, 1997.
I. Szlufarska, M. Chandross, R. W. Carpick: "Recent advances in single-asperity nahotribology", Journal of Physics D: Applied Physics, 41, 123001, 2008.
H. Holscher, A. Schirmeisen, U. D. Schwarz: "Principle of atomic friction: from sticking atoms to superlubric sliding", Philosophical Transactions of the Royal Society A, 366, pp. 1382-1404, 2008.
H. Holscher, U. D. Schwarz, O. Zworner, R. Wiesendanger: "Consequences of the stick-slip movement for the scanning force microscopy imaging of graphite", Physical Review B, vol. 57, No. 4, pp. 2477-2481, Jan. 15, 1998.
M. Dienvviebel, G. S. Verhoeven, N. Pradeep, J. W. M. Frenken, J. A. Heimberg, H. W. Zandbergen: "Superlubricity of Graphite", Physical Review Letters, vol. 92, No. 12, 126101, Mar. 26, 2004.
N. J. Mosey, M. H. Mueser, Reviews in Computational Chemistry, 25, 67, 2007.
B. Stegemann, C. Ritter, B. Kaiser, and K. Rademann: "Crystallization of Antimony Nanoparticies: Pattern Formation and Fractal Growth", Journal of Physical Chemistry B, 108, pp. 14292-14297, 2004.
N. Vandamme, E. Janssens, F. Vanhoutee, P. Lievens. C.V. Haesendonck: "Scanning probe microscopy investigation of gold clusters deposited on atomically flat substrates", Journal of Physics: Condensed Matter, 15, S2983-S2999, 2003.
P. E. Sheehan, C. M. Lieber: "Nanotribology and Nancfabrication of MoO3 Structures by Atomic Force Microscopy", Science, vol. 272, pp. 1158-1161, May 24, 1996.
C. Ritter, M. Heyde, B. Stegemann, K. Rademann, U.D. Schwarz: "Contact-area dependence of frictional forces: Moving adsorbed antimony nanoparticles", Physical Review B, 71, 085405, 2005.
D. Dietzel, C. Ritter, T. Monninghoff, H. Fuchs, A. Schirmeisen, U D. Schwarz: "Frictional Duality Observed during Nanoparticie Sliding", Physical Review Letters, 101, 125505, Sep. 19, 2008.
C. Ritter, et al: "Nonuniform friction-area dependency for antimony oxide surfaces sliding on graphite", Physical Review B, 88, 045422, 2013.
D. Dietzel, M. Feldmann, U. D. Schwarz, H. Fuchs, A. Schirmeisen: "Scaling Laws of Structural Lubricity", Physical Review Letters, 111, 235502, Dec. 6, 2013.
D. Dietzel, U. D. Schwarz, A. Schirmeisen: "Nanotribological studies using nanoparticle manipulation: Principles and application to structural lubricity"; Friction, 2, pp. 114-139, 2014.
D. Dietzel, T. Monninghoff, L. Jansen, H. Fuchs, C. Ritter, et al: "Interfacial friction obtained by lateral manipulation of nancparticies using atomic force microscopy techniques", Journal of Applied Physics, 102, 084306, 2007.
J. E. Sader, J. W. M. Chon, P. Mulvaney: "Calibration of rectangular atomic force microscope cantilevers", Review of Scientific Instruments, vol. 70, pp. 3967-3969, 1999.
M. Varenberg, I. Etsion, G. Halperin: "An improved wedge calibration method for lateral force in atomic microscopy", Review of Scientific Instruments, vol. 74, No. 7, pp. 3362-3367, Jul. 2003.
T. P. Darby, C. M. Wayman: "Nucleation and growth of gold films on graphite", Journal of Crystal Growth, 28, pp. 41-52, 1975.
C. M. Wayman, T. P. Darby: "Nucleation and growth of gold films on graphite", Journal of Crystal Growth, 28, pp. 53-67, 1975.
R. Anton, I. Schneidereit: "In situ TEM investigations of dendritic growth of Au particles on HOPG", Physical Review B, vol. 58, No. 20, pp. 13874-13881, Nov. 15, 1998.
R. Anton, P. Kreutzer: "In situ TEM evaluation of the growth kinetics of Au particles on highly oriented pyrolithic graphite at elevated temperatures", Physical Review B, vol. 61, No. 23, pp. 16077-16083, Jun. 15, 2000.
Q. M. Guo, P. Fallen, J. L. Yin, R. E. Palmer, N. Bampos, J. M. Sanders: "Growth of Densely Packed Gold Nanoparticies oh Graphite Using Molecular Templates", Advanced Materials, 15, pp. 1084-1807, Jul. 4, 2003.
H. Zhou et al:"The transformation of a gold film on few-layer graphene to produce either hexagonal or triangular nanoparticles during annealing",Carbon, 52,pp. 379-387,2013.
F. Ruffino, M. G. Grimaldi: "Atomic force microscopy study of the growth mechanisms of nanostructured sputtered Au film on Si(111): Evolution with film thickness and annealing time", Journal of Applied Physics, 107, 104321, 2010.
Y. F. Mo, K. T. Turner, I. Szlufarska: "Friction laws at the nanoscale", Nature, vol. 457, pp. 1116-1119, Feb. 26, 2009.

* cited by examiner

MATERIAL SYSTEM WITH SUB-MICROMETER-SCALE INTERFACES EXHIBITING STRUCTURAL LUBRICITY UNDER AMBIENT CONDITIONS AND THE METHOD FOR SYNTHESIS THEREOF

TECHNICAL FIELD

Invention is related with a material system with sub-micrometer-scale interfaces exhibiting structural lubricity under ambient conditions.

PRIOR ART

Despite the fact that friction is ubiquitous in mature, the fundamental physical principles that govern this interesting phenomenon are still not well understood. While the macroscopic laws of friction involving a linearly proportional relationship between the normal load ($F_a$) and the friction force ($F_f$) arising between two objects in contact have been well established since hundreds of years thanks to pioneering experiments by Amontons, Coulomb and others, the macroscopically observed proportionality constant μ the so-called friction coefficient) cannot be derived from first principles as it constitutes a complex function of interface structure, chemistry and environmental factors including temperature and humidity [1]. Moreover, the unavoidable mufti-asperity nature of interfaces famed by two macroscopic objects in contact [2] complicates the physical interpretation of macroscopic friction experiments, leading to substantial difficulties in the determination of the actual contact area (A) between the two objects, among others.

To overcome the above-mentioned difficulties associated with macroscopic tribology (the science of friction, wear and lubrication) experiments, the research field of nanotribology has been introduced relatively soon after the invention of the atomic force microscope (AFM) [3, 4]. The AFM, which can be thought of as a very high-resolution mechanical microscope, allows the recording of (sub-) nanometer-scale topography as well as normal and lateral forces experienced by a very sharp single asperity (radii of curvature usually on the order of <10 nm) in the form of a tip at the end of a micro-machined $Si/SiO_2/Si_3N_4$ cantilever during the raster-scanning of a given sample surface under slight contact (normal forces on the order of a few to tens of nN) [5]. Thanks to the single-asperity nature of the contact formed between the AFM tip and the sample surface, various nanotribology experiments conducted on a large number of sample surfaces over the last couple of decades have resulted in the precise determination of the effect of normal load, sliding velocity and temperature on frictional behavior at the nanoscale [6-8]. Moreover, phenomena such as stick-slip [9] and structural lubricity (sometimes referred to as superlubricity) [10] have been observed and largely explained, in many cases with substantial support from theory and computational work [11].

Among the material systems investigated nanotribologically using an AFM-based approach, nanoparticles on layered substrates such as highly oriented pyrolytic graphite (HOPG) [12, 13] are of particular interest since there has been a recent increase in nanotribology experiments involving the deliberate lateral manipulation of nanoparticles on structurally well-defined substrates such as HOPG and the measurement of the associated frictional forces, as a model approach to study frictional effects in devices featuring sliding components on nano- and micrometer scales [14-20].

SUMMARY OF THE INVENTION

The main difference of the present invention from other material systems of similar type is the fact that the present material system exhibits structurally lubric sliding between its components (gold nanoparticles and the graphite surface) under ambient conditions.

From now on ambient conditions will be used to define the following conditions:

Temperature between 20 and 25° C.

Standard atmospheric pressure

Relative humidity between 20% and 80%

Motivated by the discussion in the "Prior Art" section, a material system comprising of highly oriented pyrolytic graphite (HOPG) and gold nanoparticles is presented here, in particular the method for its synthesis, its structural characterization and the tribological properties that it exhibits. Specifically, the material system is characterized in having interfaces exhibiting structural lubricity under ambient conditions, as determined by atomic force microscopy (AFM)-based lateral manipulation experiments. The effects of thermal deposition amount, as well as post-deposition annealing on nanoparticle morphology and distribution are discussed via scanning electron microscopy (SEM) measurements. Results reveal that a transformation in morphology from small, non-uniformly dispersed gold islands that are coalesced to form channeled thin films on HOPG to much larger, well-faceted, mostly hexagonal AuNPs with much lower substrate coverage takes place upon post-deposition annealing. Furthermore, high-resolution transmission electron microscopy (TEM) images are utilized to confirm the crystalline character of the AuNPs. Lateral manipulation experiments performed by AFM on AuNPs exhibiting contact areas of 4000-130,000 $nm^2$ with the HOPG reveal friction forces <2.5 nN, in accordance with the theory of structural lubricity.

DETAILED DESCRIPTION OF THE INVENTION

Experimental Details: Sample Preparation

Figure 1:
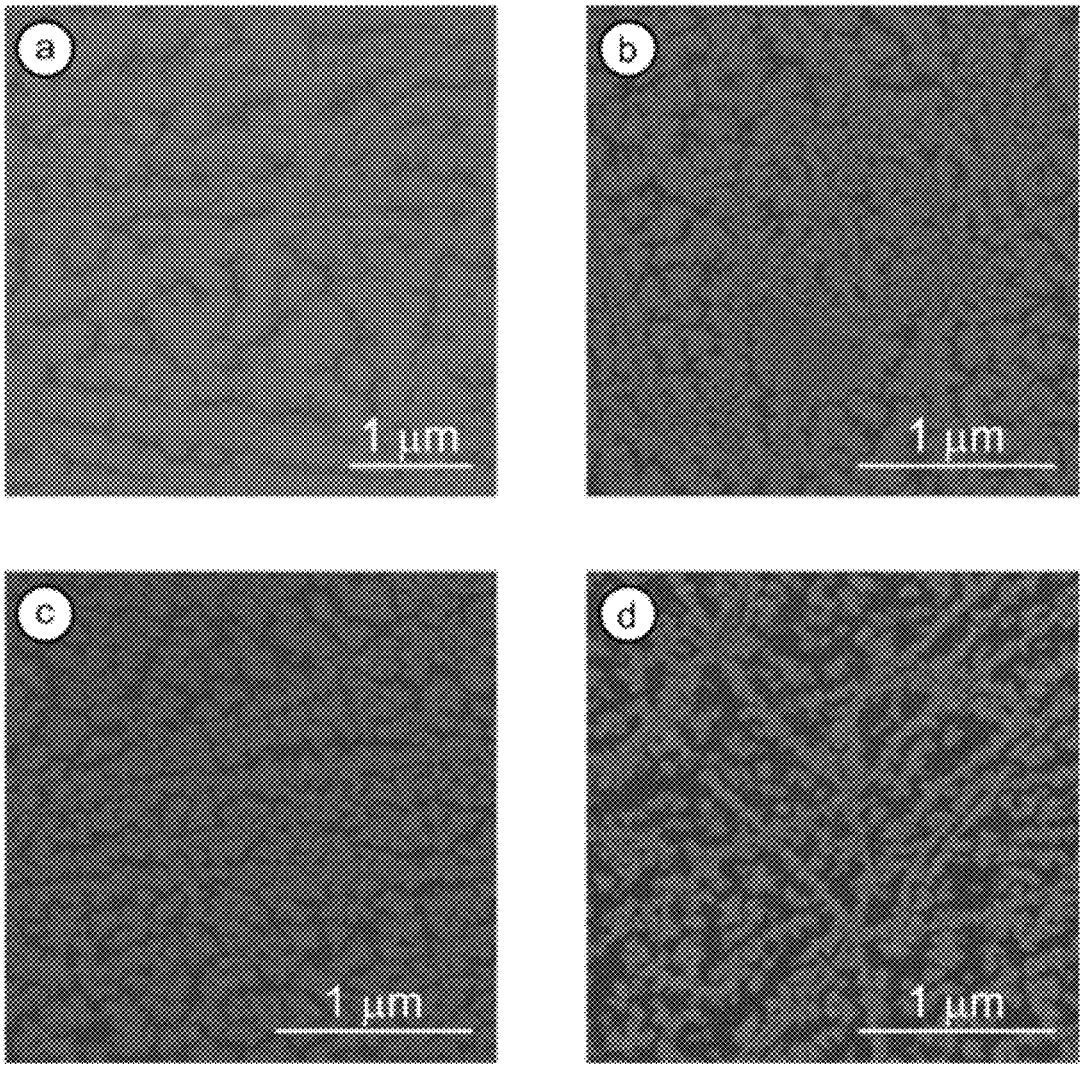
FIG. 1. SEM images of as-deposited Au thin films on HOPG for total deposition amounts of 20 Å (a), 10 Å (b), 5 Å (c) and 1 Å (d). Thermal evaporation has been performed with the HOPG substrate at room temperature, at a rate of 0.1 Å/s.

HOPG substrates (ZYA or ZYB quality is preferred) have been prepared by mechanical cleaving in air via adhesive tape and immediately transferred into the vacuum chamber of a thermal evaporation system (Vaksis PVD Vapor-3S). Thermal evaporation of 999.9 purity gold on HOPG substrates took place under high vacuum conditions (base pressure $5\times10^{-6}$ Torr) and at a deposition rate of 0.1 Å/s for total deposited amounts between 1 Å and 40 Å. During deposition, the HOPG substrate was held at room temperature. After deposition, the gold-coated HOPG substrates were removed from the evaporation system for post-deposition annealing. Post-deposition annealing at temperatures ranging from 400° C. to 650° C. and for annealing times on the order of 30 min to 4 h took place in a quartz tube furnace (Alser Teknik/ProTherm).

Experimental Details: Sample Characterization via SEM and TEM

Prior to structural and nanotribological characterization by AFM, samples prepared as detailed in the previous section have been analyzed via SEM (FEI Quanta 201) FEG, typically operated at 10 kV) to study the morphology and the distribution of AuNPs on HOPG. Additionally, high-resolution TEM (FEI Tecnai G2 F30, typically operated at 300 kV) has been utilized to confirm the crystalline structure of AuNPs via direct imaging as well as electron diffraction. Regular TEM samples have been prepared by mechanical cleavage of a thin layer of the gold-covered HOPG sample and subsequent sonication in ethanol, followed by drop-casting on a Cu grid (300 mesh). For cross-sectional TEM measurements, samples are prepared by epoxy-coating and subsequent field ion beam (FIB)-milling of a region of the material system that contains at least one AuNP.

Experimental Details: Nano-Manipulation Experiments via AFM

Complementary to SEM and TEM measurements, AFM-based nano-manipulation experiments have been performed to study friction forces as a function of contact area associated with the interfaces between individual AuNPs and HOPG. A commercial AFM instrument (PSIA XE-100) has been operated under ambient conditions and in the contact mode to perform the experiments. Silicon cantilevers (Nanosensors PPP-CONTR series, radius of curvature≈10 nm) have been used during AFM measurements. To determine the normal as well as the lateral forces detected during AFM measurements, cantilevers have been calibrated according to the methods reported by Sader et al. [21] and Varenberg et al. [22], respectively. The nanoparticles are pushed from the side in contact mode and related friction forces during sliding are quantified via standard methods reported in the literature [20].

Effect of Deposition Amount and Post-Deposition Annealing on Morphology

In order to obtain a heterogeneous sample system consisting of individual AuNPs of well-defined shape and reasonable lateral separation on HOPG suitable for AFM-based nano-manipulation experiments, the first preparation step involved the thermal evaporation of gold onto freshly cleaved HOPG substrates. The growth kinetics and morphological characteristics of thin films of gold on HOPG have received particular attention in the past, where typically non-uniform surface coverages have been observed due to the relatively low surface energy exhibited by the HOPG substrate [23-27]. While faceted and mostly hexagonal or triangular-shaped Au nanoparticles are obtained when evaporation is performed at elevated substrate temperatures, deposited films consisting of interconnected, elongated islands leading to a channeled morphology are expected for depositions where the substrate is held at room temperature.

FIG. 1 demonstrates the effect of thermal deposition amount on the resulting thin film morphology for film thicknesses of 20 Å, 10 Å, 5 Å and 1 Å via SEM images recorded post-deposition. Starting from a thickness of 20 Å, close to full surface coverage is observed while at increasingly smaller film thicknesses, thin film morphologies comprising interconnected, non-uniformly dispersed and irregularly-shaped gold islands are visible. The surface coverage and average island size gradually drop with smaller deposition amounts, until uncovered regions of the substrate on the order of several hundreds of nm become observable at a deposition amount of 1 Å. The fact that an accumulation of gold islands along certain linear features on the substrates becomes detectable at small deposition amounts such as 1 Å supports the argument that nucleation and growth primarily occurs at surface defects such as step edges and grain boundaries, in accordance with results from the literature [27].

Figure 2:
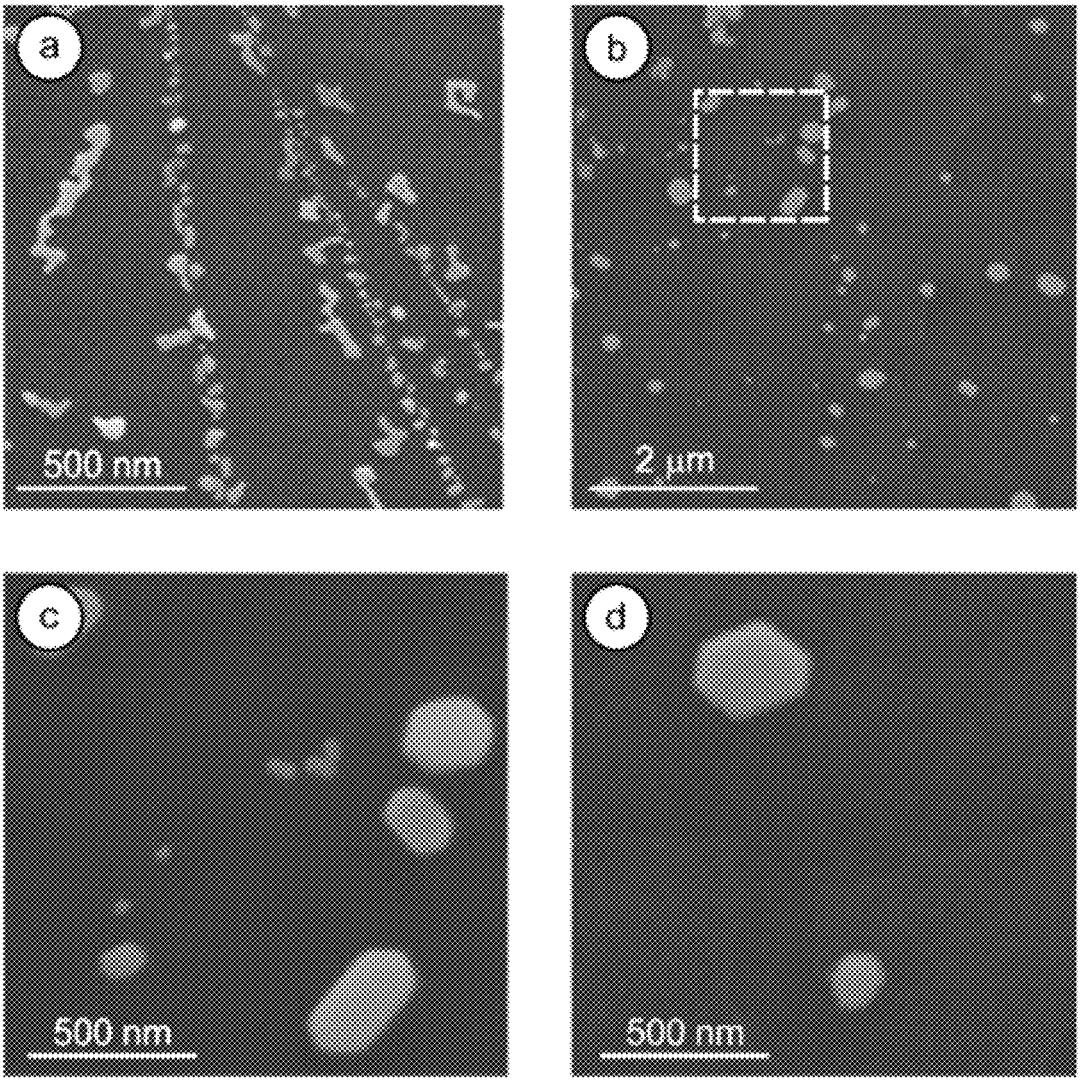
FIG. 2. SEM images of the AuNP/HOPG sample system after post-deposition annealing at (a) 500° C. for 30 min., (b, c) 600° C. for 2 h and (d) 650° C. for 2 h. The SEM image presented in (c) is a zoomed-in view of the region of the sample surface designated by the dashed white rectangle in (b). The formation of well-faceted AuNPs at elevated temperatures is readily observed.

While the SEM study presented in FIG. 1 regarding the morphology of gold thin films on HOPG as a function of deposition amount provides useful information, the resulting material system is unsuitable for precise nano-manipulation experiments via AFM due to the lack of structurally well-defined AuNPs at reasonable separations (at least several hundreds of nm) from each other. In order to transform the as-deposited gold films into faceted AuNPs, post-deposition annealing in a quartz furnace has been performed at temperatures ranging from 400° C. to 650° C. and for annealing times on the order of 30 min. to 4 h. Please note that due to the relatively low surface coverage, samples comprising 1 Å of deposited gold on HOPG (FIG. 1(*d*)) have been employed for annealing. The results indicate that post-deposition annealing has a drastic effect on the morphology and distribution of gold on HOPG, leading to a severe reduction of suffice coverage and significant coalescence. While annealing temperatures up to 500° C. only result in the observation of non-faceted gold islands in elongated, shapes (FIG. 2(*a*)) up to 4 h of annealing time; well-faceted, hexagonal/elongated-hexagonal AuNPs of 50-180 nm height and up to 500 nm in lateral dimensions are obtained at annealing temperatures of 600-650° C. (FIG. 2(*b-d*)), in accordance with recent studies performed on gold thin films on multilayer graphene [28]. Annealing at higher temperatures (700° C. and above) has been observed to result in minor but detectable morphological damage on the HOPG surface and is thus prevented.

Figure 3:
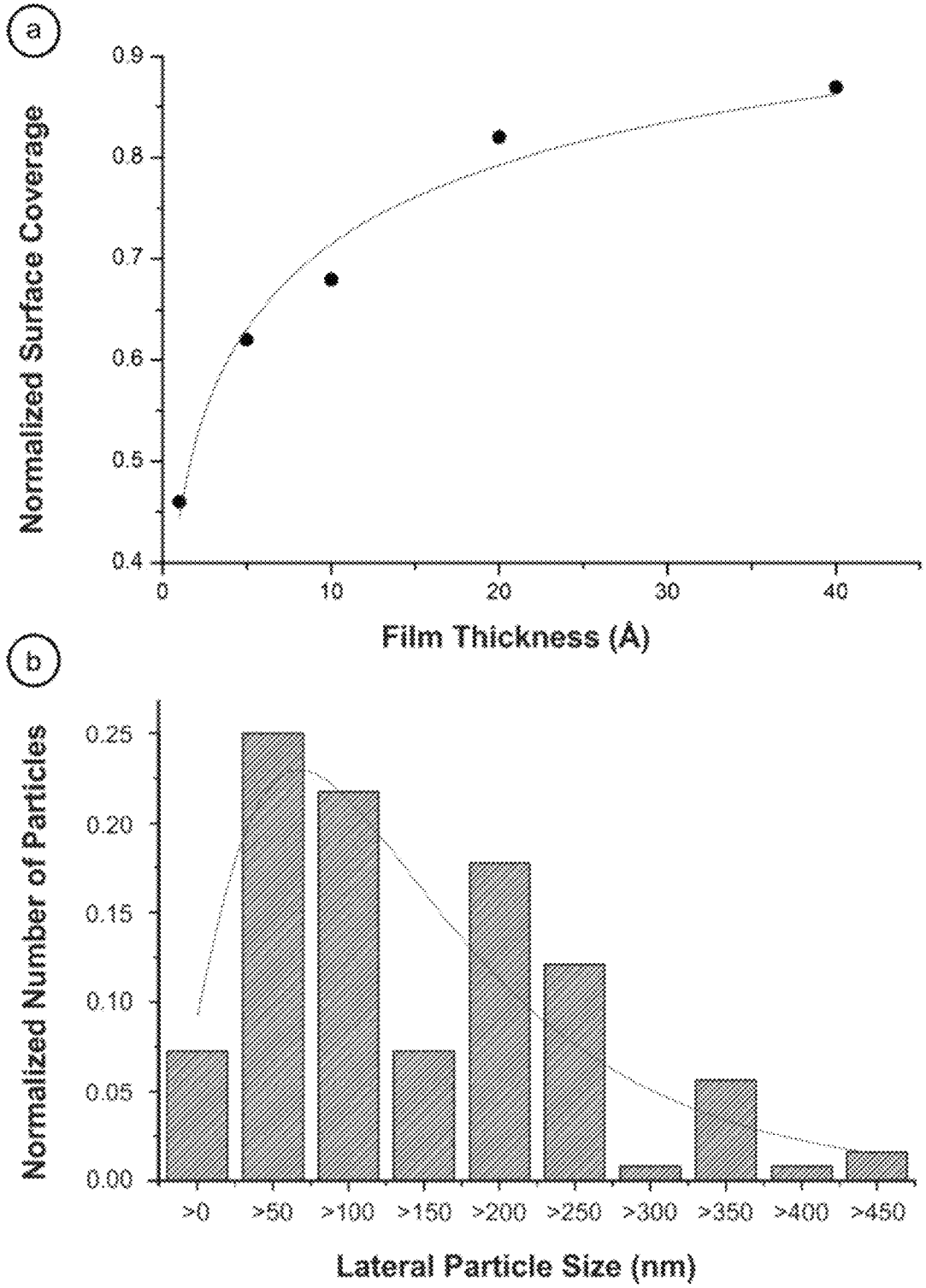
FIG. 3. (a) Surface coverage of Au on HOPG as a function of film thickness. An Avrami-type fit represented by the red solid curve reasonably describes film growth. (b) AuNP size distribution after post-deposition annealing at 600-650° C. Lateral, particle sizes up to 500 nm are observed. The solid red curve is a fit by the log-normal function.

The coverage of the HOPG substrate by Au as a function of film thickness (FIG. 3(*a*)), as well as the lateral size distribution of AuNPs obtained after post-deposition annealing (FIG. 3(*b*)) are also analyzed. Our results regarding surface coverage as a function of film thickness are in line with the dynamic scaling theory of growing interfaces, favoring a lateral growth and surface-diffusion-driven coalescence process, owing to the relatively weak chemical interactions between the adsorbed Au atoms and the HOPG surface (FIG. 3(*a*)) [29]. We observe a relatively wide distribution of AuNP sizes up to 500 nm (FIG. 3(*b*)). The wide distribution of AuNP lateral size is favorable for nanotribological investigations, as it allows to perform nano-manipulation experiments where interfacial friction forces acting on AuNPs of different size shall be quantified.

Confirmation of Nanoparticle Crystallinity via TEM

It has been shown via a number of experiments and first principles calculations that friction occurring between two bodies in contact is a function of the physical properties of the interface—mainly its structure [17, 18, 30]. As such, in order to study carefully the effect of interface structure on friction at the nanoscale, structurally well-defined, i.e. crystalline, surfaces are a prerequisite. Pioneering nano-manipulation experiments conducted in this fashion primarily focused on Sb nanoparticles, which undergo a size-dependent phase transition from amorphous to crystalline at a particle size of ~15,000 $nm^2$ and are unavoidably covered by an amorphous antimony oxide shell when exposed to the ambient [17]. In contrast, AuNPs on substrates such as HOPG constitute an alternative material system for nano-manipulation experiments, where the crystallinity of the interface should be conserved even under ambient conditions.

Figure 4:
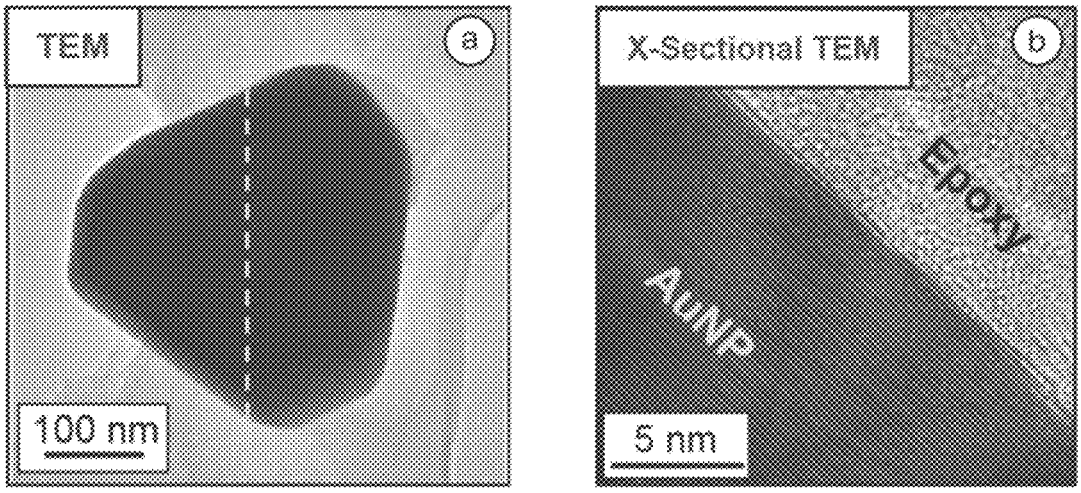
FIG. 4. (a) Top-view TEM image of an individual AuNP with well-defined, facets. (b) Cross-sectional, high-resolution TEM image of a AuNP, confirming the crystalline structure and the absence of an oxidation layer.

TEM measurements are performed to confirm the crystalline character of thermally deposited and post-deposition annealed AuNPs on HOPG (FIG. 4). FIG. 4(*a*) displays a top-view TEM image of an individual AuNP with well-defined facets whereas the cross-sectional, high-resolution TEM image in FIG. 4(*b*) reveals in high detail the crystalline structure of the AuNP, all the way to the very edge, proving that the AuNP is not oxidized on its surface and thus is suitable for studies of structural lubricity. Please note that since the investigated AuNPs have been exposed to ambient conditions for several weeks, the possibility for the formation of an oxide layer on AuNPs during extended time periods is thus excluded.

Structurally Lubric Sliding Under Ambient Conditions

During contact-mode AFM scanning of the AuNP/HOPG material system, it is observed that AuNPs on graphite terraces are easily pushed laterally by the plowing action of the FFM tip during scanning (even under applied normal loads <1 nN). As such, research has been aimed at characterizing the associated interfacial friction forces. Nano-manipulation experiments performed according to standard procedures in the literature [20] on a large number (37) of AuNPs have revealed the occurrence of structurally lubric sliding under ambient conditions for this material system such that all AuNPs investigated undergo friction forces less than 2.5 nN while sliding on HOPG. It should be noted that the AuNPs investigated exhibit contact areas of 4000-130,000 $nm^2$ with the HOPG substrate, measured via the determination of AuNP sizes from topographical, contact-mode AFM images [20]. According to the theory of structural lubricity [18], the friction force (F) experienced at the interface between two crystalline and incommensurate surfaces should scale sub-linearly with the number of atoms on the sliding interface (N) such that:

$$F \sim F_0 N^{\gamma}; 0\text{-}0.05$$

Figure 5:
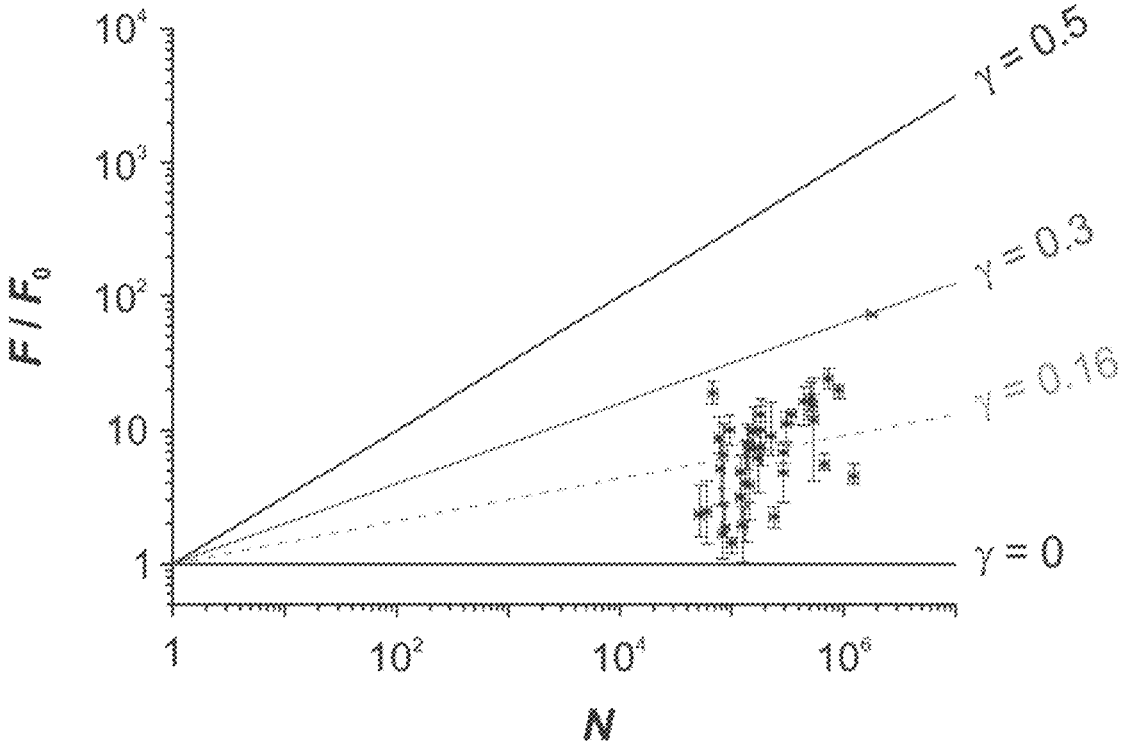
FIG. 5. The dependence of the normalized friction ($F/F_0$) experienced by AuNPs sliding on graphite on the number of gold atoms at the sliding interface (N). Please note that N is found by multiplying the contact area between individual. AuNPs and the HOPG substrate by the density of atoms on the Au(111) surface (14.03 per $nm^2$) [18]. As one can clearly see from the figure, all investigated nanoparticles exhibit structurally lubric sliding, with the γ value for all measurements located between 0 and 0.3.

Here, $F_0$ is the theoretically expected friction force for a single gold atom diffusing on HOPG as calculated by $\Delta E|\alpha$ where $\Delta E$ is the associated energy barrier for diffusion (50 meV) and $\alpha$ is the lattice constant of HOPG (0.246 nm) [18]. As such, $F_0$ can be calculated to be equal to 0.0326 nN. As seen in FIG. 5, all AuNPs investigated via nano-manipulation experiments for the present material system exhibit structurally lubric sliding, with the $\gamma$ value for all measurements located between 0 and 0.3.

REFERENCES

[1]B. Bhushan, Introduction to Tribology, Wiley, New York, 2013.

[2] J. A. Greenwood, J. B. P. Williamson. Proceedings of the Royal Society of London A 295 (1966) 300.

[3] B. Bhushan, J. N. Israelachvili, U. Landman, Nature 374 (1995) 607.

[4] C. M. Mate, Tribology on the Small Scale: A Bottom Up Approach to Friction, Lubrication, and Wear, Oxford University Press, Oxford, 2008.

[5] P. J. Eaton, P. West, Atomic Force Microscopy, Oxford University Press, Oxford, 2010.

[6] R. W. Carpick, M. Salmeron, Chemical Reviews 97 (1997) 1163.

[7] I. Szlufarska, M. Chandross, R. W. Carpick, Journal of Physics D: Applied Physics 41 (2008) 123001.

[8] H. Holscher, A. Schirmeisen, U. D. Schwarz, Philosophical Transactions of the Royal Society A 366 (2008) 1383.

[9] H. Holscher, U. D. Schwarz, O. Zworner, R. Wiesendanger, Physical Review B 57 (1998) 2477.

[10] M. Dienwiebel, G. S. Verhoeven, N. Pradeep, J. W. M. Frenken, J. A. Heimberg, H. W. Zandbergen, Physical Review Letters 92 (2004) 126101.

[11] N. J. Mosey, M. H. Mueser, Reviews in Computational Chemistry 25 (2007) 67.

[12] B. Stegemann C. Ritter, B. Kaiser, and K. Rademann, Journal of Physical Chemistry B 108, 14292 (2004).

[13] N. Vandamme, E. Janssens, F. Vanhoutee, P. Lievens, C. V. C. M. Haesendonck, Journal of Physics: Condensed Matter 15 (2003) S2983.

[14] P. E. Sheehan, C. M. Lieber, Science 272 (1996) I158.

[15] C. Ritter, M. Heyde, B. Stegemann, K. Rademann, U. D. Schwarz, Physical Review B 71 (2005) 085405.

[16] D. Dietzel, C. Ritter, T. Mönninghoff, H. Fuchs, A. Schirmeisen, U. D. Schwarz, Physical Review Letters 101 (2008) 125505.

[17] C. Ritter, et al., Physical Review B 88 (2013) 045422.

[18] D. Dietzel, M. Feldmann, U. D. Schwarz, H. Fuchs, A. Schirmeisen, Physical Review Letters 111 (2013) 235502.

[19] D. Dietzel, U. A. Schwarz, A. Schirmeisen, Friction 2 (2014) 114.

[20] D. Dietzel, T. Mönninghoff, L. Jansen, H. Fuchs, C. Ritter, U. D. Schwarz, A. Schirmeisen, Journal of Applied Physics 102 (2007) 084306.

[21] J. E. Sader, J. W. M. Chon, P. Mulvaney, Review of Scientific Instruments 70 (99) 3967.

[22] M. Varenberg, I. Etsion, G. Halperin, Review of Scientific Instruments 74 (2003) 3362.

[23] T. P. Darby, C. M. Wayman, Journal of Crystal Growth 28 (1975) 41.

[24] C. M. Wayman, I. P. Darby, Journal of Crystal Growth 28 (1975) 53.

[25] R. Anton, I. Schneidereit, Physical Review B 58 (1998) 13874.

[26] R. Anton, P. Kreutzer, Physical Review B 61 (2000) 16077.

[27] Q. M. Guo, P. Fallon, J. L. Yin, R. E. Palmer, N. Bampos, J. M. Sanders, Advanced Materials 15 (2003) 1084.

[28] H. Zhou, et al., Carbon 52 (2013) 379.

[29] F. Ruffino, M. G. Grimaldi, Journal of Applied Physics 107 (2010) 104321.

[30] Y F. Mo, K, T. Turner, I. Szlufarska, Nature 457 (2009) 1116.

The invention claimed is:

1. A material system, comprising: a highly oriented pyrolytic graphite (HOPG) substrate and gold nanoparticles, wherein the material system has interfaces exhibiting structural lubricity under a predefined condition, wherein lateral dimensions of the gold nanoparticles are between 10-500 nm;

each of the gold nanoparticles has a crystalline structure;

surfaces of the gold nanoparticles are not oxidized;

a contact area between each of the gold nanoparticles and the highly oriented pyrolytic graphite (HOPG) substrate is within 4,000-130,000 $nm^2$.

2. The material system according to claim 1, wherein a friction forces less than 2.5 nN is exerted at the interfaces between the highly oriented pyrolytic graphite (HOPG) substrate and the gold nanoparticles during sliding.

3. The material system according to claim 1, wherein the highly oriented pyrolytic graphite (HOPG) substrate is of grade ZYA or grade ZYB.

4. A method for producing a material system, wherein the material system comprises a highly oriented pyrolytic graphite (HOPG) substrate and gold nanoparticles, and the material system has interfaces exhibiting structural lubricity under a predefined condition, wherein lateral dimensions of the gold nanoparticles are between 10-500 nm;

each of the gold nanoparticles has a crystalline structure;

surfaces of the gold nanoparticles are not oxidized;

a contact area between each of the gold nanoparticles and the highly oriented pyrolytic graphite (HOPG) substrate is within 4,000-130,000 $nm^2$;

the method comprising:

i. preparing the highly oriented pyrolytic graphite (HOPG) substrate by mechanical cleaving in air;

ii. thermally evaporating 999.9 purity gold on the highly oriented pyrolytic graphite (HOPG) substrate at room temperature in a high vacuum, wherein an amount of the gold is within 1-40 Å;

iii. annealing under atmospheric pressure at a temperature between 600 and 650° C. for 30 mins to 4 hours.

5. The method according to claim 4, wherein the gold is in an amount of 1 Å.

6. The method according to claim 4, wherein an annealing temperature is 600° C.

7. The method according to claim 4, wherein annealing time is 2 hours.

8. The method according to claim 4, wherein the annealing is performed in a quartz tube furnace.

* * * * *